US007528678B2

(12) United States Patent
Tamura et al.

(10) Patent No.: US 7,528,678 B2
(45) Date of Patent: May 5, 2009

(54) ANTENNA SWITCH MODULE

(75) Inventors: Masaya Tamura, Osaka (JP); Yoshikuni Fujihashi, Hyogo (JP)

(73) Assignee: Panasonic Corporation, Osaka (JP)

( * ) Notice: Subject to any disclaimer, the term of this patent is extended or adjusted under 35 U.S.C. 154(b) by 388 days.

(21) Appl. No.: 10/565,768

(22) PCT Filed: Jul. 14, 2005

(86) PCT No.: PCT/JP2005/013031

§ 371 (c)(1),
(2), (4) Date: Jan. 24, 2006

(87) PCT Pub. No.: WO2006/022093

PCT Pub. Date: Mar. 2, 2006

(65) Prior Publication Data

US 2008/0055187 A1 Mar. 6, 2008

(30) Foreign Application Priority Data

Aug. 27, 2004 (JP) ..... 2004-248044

(51) Int. Cl.
*H01P 1/10* (2006.01)
*H01P 5/18* (2006.01)
*H01P 5/12* (2006.01)

(52) U.S. Cl. ..... 333/103; 333/109; 333/126

(58) Field of Classification Search ..... 333/103, 333/101, 104, 109, 116, 117, 125, 126, 132; 455/13.3, 101, 78, 80, 78.8
See application file for complete search history.

(56) References Cited

U.S. PATENT DOCUMENTS 6,118,409 A * 9/2000 Pietsch et al. ..... 343/703
6,236,841 B1 * 5/2001 Akiya ..... 455/91
7,027,779 B2 * 4/2006 Tai et al. ..... 455/83
2002/0113666 A1 * 8/2002 Yamazaki et al. ..... 333/109
2003/0076195 A1 * 4/2003 Ishizaki et al. ..... 333/133
2004/0005867 A1 * 1/2004 Yu ..... 455/78

FOREIGN PATENT DOCUMENTS

EP 1 061 662 A1 12/2000
JP 61-077408 4/1986
JP 2001-127652 A 5/2001
JP 2002-052644 A 2/2002

(Continued)

OTHER PUBLICATIONS

International Search Report for application No. PCT/JP2005/013031 dated Nov. 1, 2005.

*Primary Examiner*—Benny Lee
*Assistant Examiner*—Gerald Stevens
(74) *Attorney, Agent, or Firm*—RatnerPrestia

(57) ABSTRACT

An antenna switch module includes a filter which reduces transmission loss so as to achieve high attenuation in a wide band at harmonic frequencies. This antenna switch module includes the filter, an antenna switch circuit and an adjustment line. The filter passes fundamental frequencies and has an attenuation pole. The antenna switch circuit switches antennas. The adjustment line is connected between the filter and the antenna switch circuit. The adjustment line adjusts its length, and when the filter and the antenna switch circuit are directly connected with each other at a connection point, prevents the impedance when the filter is seen from the connection point and the impedance when the antenna switch circuit is seen from the connection point from becoming complex conjugates of each other at the harmonic frequencies.

11 Claims, 8 Drawing Sheets

FOREIGN PATENT DOCUMENTS

| | | | |
|---|---|---|---|
| JP | 2002-305463 | A | 10/2002 |
| JP | 2003-008468 | A | 1/2003 |
| JP | 2005-223679 | A | 8/2005 |
| JP | 2005-236839 | A | 9/2005 |
| WO | WO 00/28673 | A | 5/2000 |
| WO | WO 00/67395 | A | 11/2000 |

* cited by examiner

ANTENNA SWITCH MODULE

This application is a U.S. National Phase Application of PCT International Application PCT/JP2005/013031.

TECHNICAL FIELD

The present invention relates to an antenna switch module including an antenna switch which switches antennas, and a filter which passes fundamental frequencies and has an attenuation pole.

BACKGROUND ART

FIG. 12 shows a block diagram of a conventional communication device including conventional antenna switch module 80. Conventional antenna switch module 80 will be described with FIG. 12. In FIG. 12, the communication device includes antenna switch module 80, transmission part 41, reception part 42, filter 83, antennas 44 and 45, and capacitors C81 to C84.

Conventional antenna switch module 80 includes antenna switch circuit 87 and filter 86. Signals from transmission part 41 are inputted to filter 86 through capacitor 81. Filter 86 passes fundamental frequencies and removes unnecessary signals. Signals outputted from filter 86 are emitted from antenna 44 or 45 selected by antenna switch circuit 87, after passing through capacitor C83 or C84.

On the other hand, signals which are received by antenna 44 or 45 selected by antenna switch circuit 87 and then are passed through capacitor C83 or C84 are inputted to filter 83 through capacitor C82. Filter 83 removes unnecessary signals from the received signals and outputs them to reception part 42. Reception part 42 demodulates the signals from filter 83.

Filter 86 included in antenna switch module 80 will be described with reference to FIGS. 13 to 16. FIG. 13 shows the structure of the filter for the conventional antenna switch module. In FIG. 13, capacitors C94 connected to the ground are open circuit to low frequency components and are short circuit to high frequency components. Inductor L94 connected in series with capacitors C94 are short circuit to low frequency components and are open circuit to high frequency components. Thus, the filter shown in FIG. 13 is a low pass filter, which passes low frequency components only.

The low pass filter shown in FIG. 13 has a large circuit size because rapid attenuation can be achieved only by a large number of stages. Alternatively, rapid attenuation can be achieved by a few number of stages when the constant of each element of this filter is determined in such a manner as to make the filter a Chebychev low pass filter. However, it is difficult for this filter to achieve wideband filtering at low loss because the filter has ripples in the passband. Another possible structure is achieved by the use of distributed constant lines. In this case, however, when a certain frequency is reached, inductive distributed constant lines are changed to capacitive distributed constant lines, whereas capacitive distributed constant lines are changed to inductive distributed constant lines. The input impedance greatly changes depending on the frequency, thereby sometimes causing the filter to lose its function as a filter.

In view of this situation, a polarized low pass filter shown in FIG. 14 has been contrived. FIG. 14 shows the structure of this filter for the conventional antenna switch module. FIG. 15 shows frequency characteristics of this filter for the conventional antenna switch module. The principle of operation of the filter will be briefly described with FIGS. 14 and 15.

Polarized low pass filter 90 includes LC series circuits 96, 98 and 99. As shown in FIG. 15, the attenuation band in the frequency characteristics of filter 90 has three poles: a first pole of 13.2 KHz; a second pole of 15.4 KHz and a third pole of 25.3 KHz. Here, for example, decreasing the resonant frequency of LC series circuit 98, that is, the second pole frequency can reduce the interval between the first pole and the second pole. Reducing the interval between these poles results in an increase in the amount of attenuation between the poles.

As a filter for the conventional antenna switch module, one example of the aforementioned polarized low pass filter is disclosed in Japanese Patent Unexamined Publication No. 61-77408.

Another known filter for an antenna switch module is a notch filter with little filtering loss. A notch low pass filter can be formed of a combination of a plurality of ¼ wavelength open stubs and ½ wavelength terminated stubs. FIG. 16 shows frequency characteristics when antenna 44 or 45 is seen from transmission part 41 in a case where filter 86 of the conventional antenna switch module is a notch filter. Fundamental frequencies are from F1=4.9 GHz to F2=5.85 GHz. Second harmonic frequencies are from F3=9.8 GHz to F4=11.7 GHz. Third harmonic frequencies are from F5=14.7 GHz to F6=17.55 GHz. The frequencies of the attenuation poles are set so as to attenuate the second and third harmonics.

In such a conventional structure, the second harmonic frequencies have small attenuation at other than the two attenuation poles F3 and F4, and the third harmonic frequencies have small attenuation at other than the two attenuation poles F5 and F6. In other words, the impedance when the output side of filter 86 is seen from the input side, and the impedance when the input side is seen from the output side both approach 50 ohms. On the other hand, impedance Z813 when terminal T83 connected with capacitor C83 is seen from terminal T81 of antenna switch circuit 87, which is connected with filter 86 is about 50 ohms at the fundamental frequencies. Impedance Z842 when terminal T82 connected with capacitor C82 is seen from terminal T84 connected with capacitor C84 is also about 50 ohms at the fundamental frequencies. On the other hand, impedance Z814 when terminal T84 is seen from terminal T81 and impedance Z832 when terminal T82 is seen from terminal T83 are open circuit. However, as the frequency gets higher, the capacity component and induction component of the package and terminals of the PIN diode become influential. This causes impedances Z813, Z842, Z814 and Z832 to change their values. More specifically, impedances Z813 and Z842 have values close to open circuit at the harmonic frequencies ranging from 4.9 GHz to 5.85 GHz, and impedances Z814 and Z832 have values close to 50 ohms. As a result, at the harmonic frequencies, the impedance Z813 when filter 86 is seen from terminal T81, and impedance Z814 when antenna switch circuit 87 is seen from terminal T81 can be complex conjugates of each other. This may deteriorate the amount of attenuation at the attenuation poles or cause a rebound phenomenon between the attenuation poles, thereby making it impossible to have enough attenuation.

SUMMARY OF THE INVENTION

The present invention provides an antenna switch module including a filter which can reduce filtering loss so as to achieve high attenuation in a wide band at harmonic frequencies.

The antenna switch module of the present invention includes the filter, an antenna switch circuit and an adjustment line. The filter passes fundamental frequencies and has an attenuation pole. The antenna switch circuit switches antennas matching the fundamental frequencies. The adjustment line is connected between the filter and the antenna switch circuit, and adjusts properties of the fundamental frequencies at the harmonic frequencies. When the filter and the antenna switch circuit are directly connected with each other at a connection point, the adjustment line prevents the impedance when the filter is seen from the connection point and the impedance when the antenna switch circuit is seen from the connection point from becoming complex conjugates of each other at the harmonic frequencies.

This antenna switch module can easily reduce rebound components between the attenuation poles of the filter at the harmonic frequencies without degrading the amount of attenuation at the attenuation poles, thereby fully attenuating the harmonic components without increasing the number of stages of the filter. For example, fundamental frequency signals amplified by a power amplifier in the front end module of a wireless LAN (Local Area Network) are passed at low loss, and the harmonic components generated by the power amplifier can be removed in a wide band at high attenuation.

REFERENCE MARKS IN THE DRAWINGS

Figure 1:
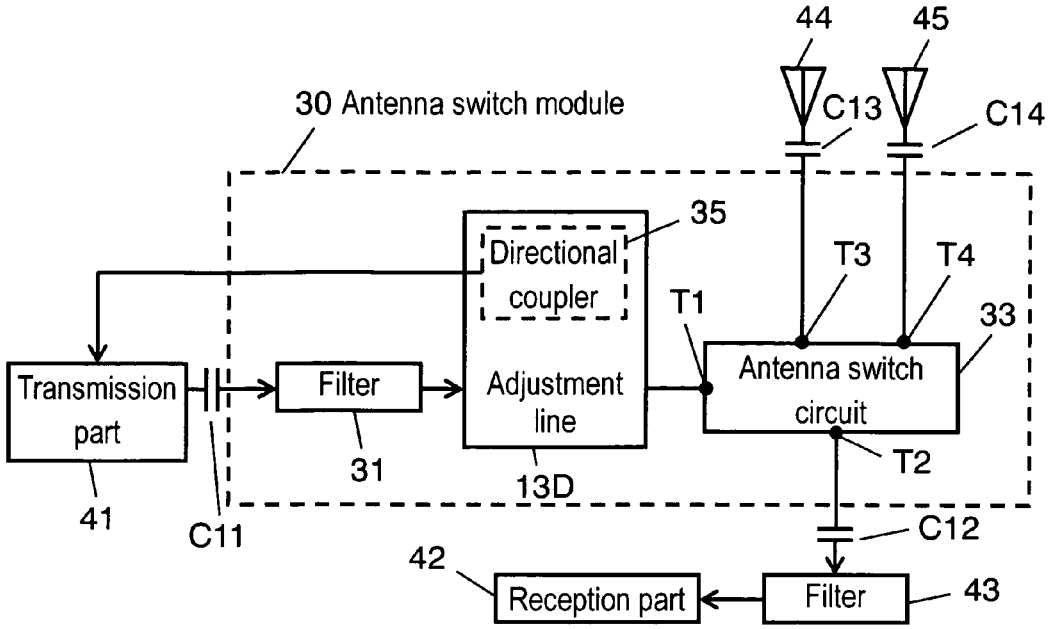
FIG. 1 is a block diagram showing the structure of a communication device including an antenna switch module of an embodiment of the present invention.

3, 7, 8 round conductor
4, 5A, 5B ground part
6A, 6B, 6C, 6D, 6E electrode
11A, 11B, 11C, 11D, 13A, 13B, 13C stripline
13D adjustment line
15 coupling line
30 antenna switch module
31, 43 filter
33 antenna switch circuit
35 directional coupler
41 transmission part
42 reception part
44, 45 antenna
51 passing signal
52 reflected signal

DETAILED DESCRIPTION OF PREFERRED EMBODIMENT

An embodiment of the present invention will be described as follows with drawings.

FIG. 1 is a block diagram showing the structure of a communication device including an antenna switch module of the embodiment of the present invention. In FIG. 1, a communication device includes antenna switch module 30, transmission part 41, reception part 42, filter 43, antennas 44 and 45, and capacitors C11 to C14. Antenna switch module 30 includes antenna switch 33, filter 31 and adjustment line 13D. Adjustment line 13D, together with other components described later, make up directional coupler 35.

Signals from transmission part 41 are inputted to filter 31 through capacitor C11. Filter 31 is a notch low pass filter which removes unnecessary harmonic signals contained in the signals from transmission part 41. Filter 31 has fundamental frequencies of 4.9 to 5.85 GHz. The second harmonic frequencies are from 9.8 to 11.7 GHz, and the third harmonic frequencies are from 14.7 to 17.55 GHz. Signals outputted from filter 31 are inputted to antenna switch circuit 33 through adjustment line 13D made of stripline. The signals inputted through adjustment line 13D are emitted from antenna 44 or 45 selected by antenna switch circuit 33, after passing through capacitor C13 or C14.

On the other hand, signals received by antenna 44 or 45 selected by antenna switch circuit 33 through capacitor C13 or C14 are inputted to filter 43 through capacitor C12. Filter 43 removes unnecessary signals from the received signals, and outputs them to reception part 42. Reception part 42 demodulates the signals from filter 43.

Figure 2:
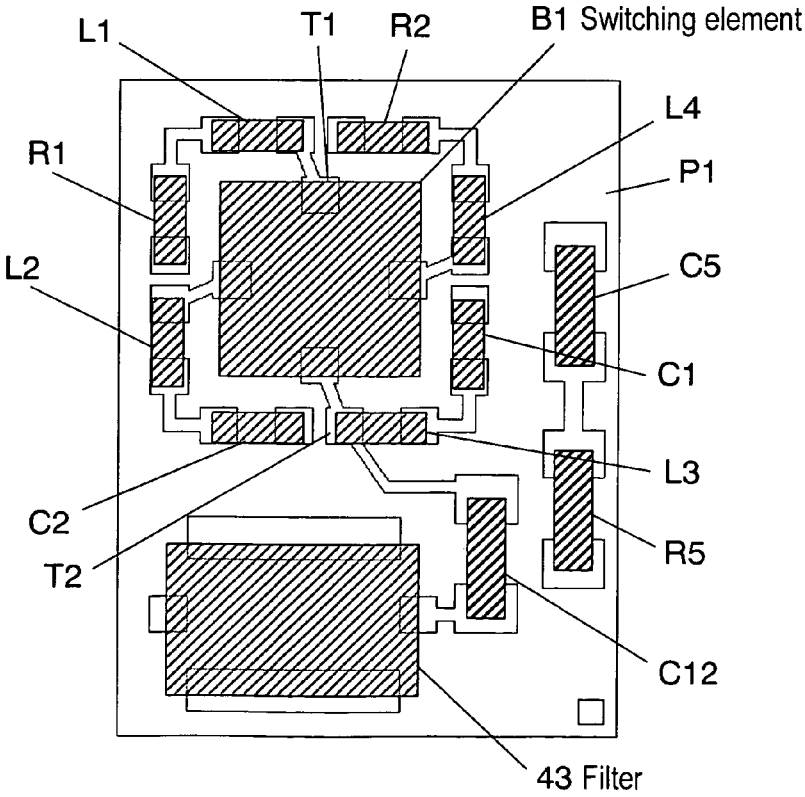
FIG. 2 shows a first layer of the antenna switch module of the embodiment.

FIGS. 2 to 7 show the respective layers of a multilayer substrate in the case where the antenna switch module of the present embodiment is compliant with IEEE802.11a. FIG. 2 shows first layer P1, which is the uppermost layer. First layer P1 is provided thereon with switching element B1, inductors L1 to L4, capacitors C1, C2 and resistors R1, R2 so as to form antenna switch circuit 33. Switching element B1 is made up of PIN diodes D1 to D4. First layer P1 is further provided thereon with capacitor C12, filter 43, and capacitor C5 and resistor R5 which are components of directional coupler 35.

Figure 3:
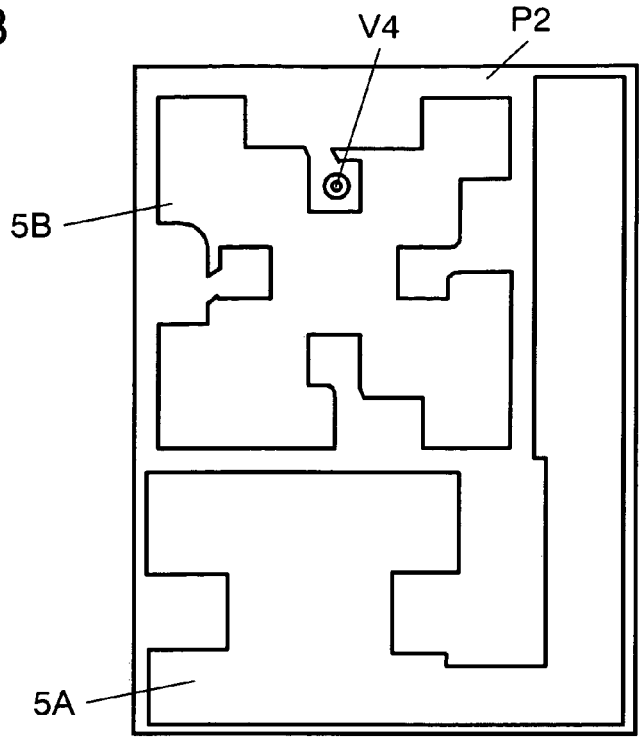
FIG. 3 shows a second layer of the antenna switch module of the embodiment.
Figure 4:
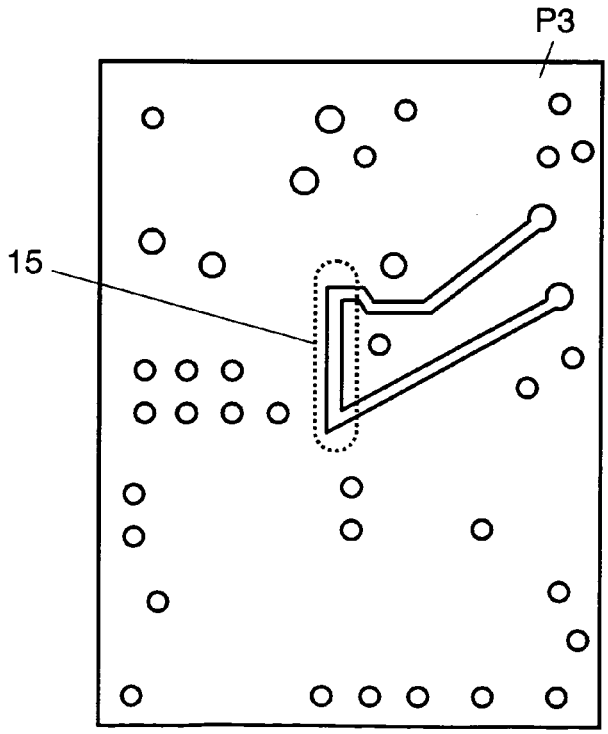
FIG. 4 shows a third layer of the antenna switch module of the embodiment.
Figure 5:
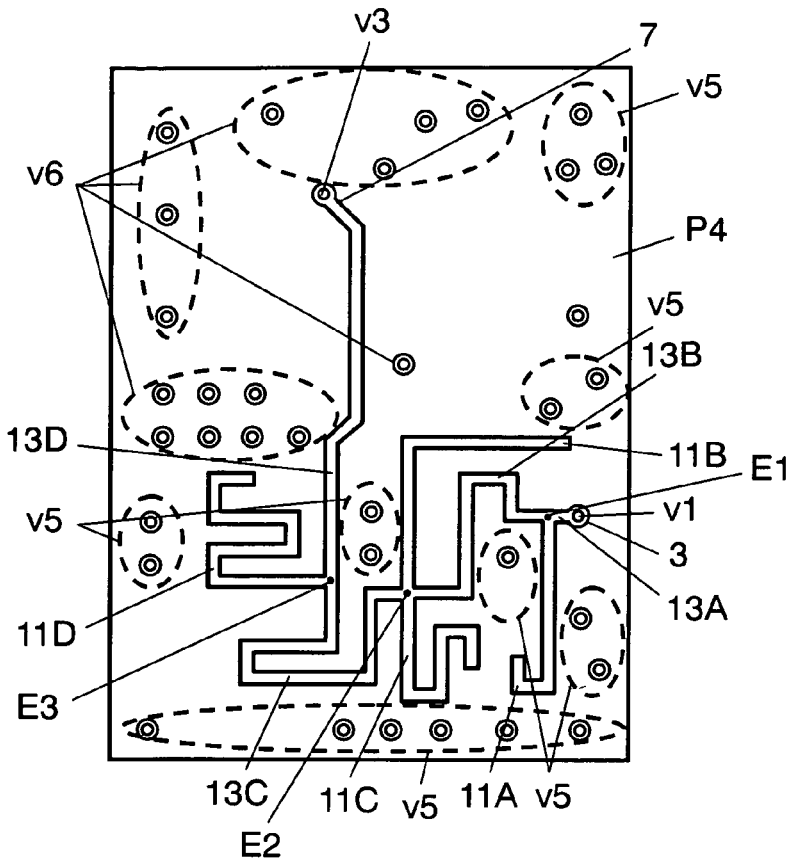
FIG. 5 shows a fourth layer of the antenna switch module of the embodiment.
Figure 6:
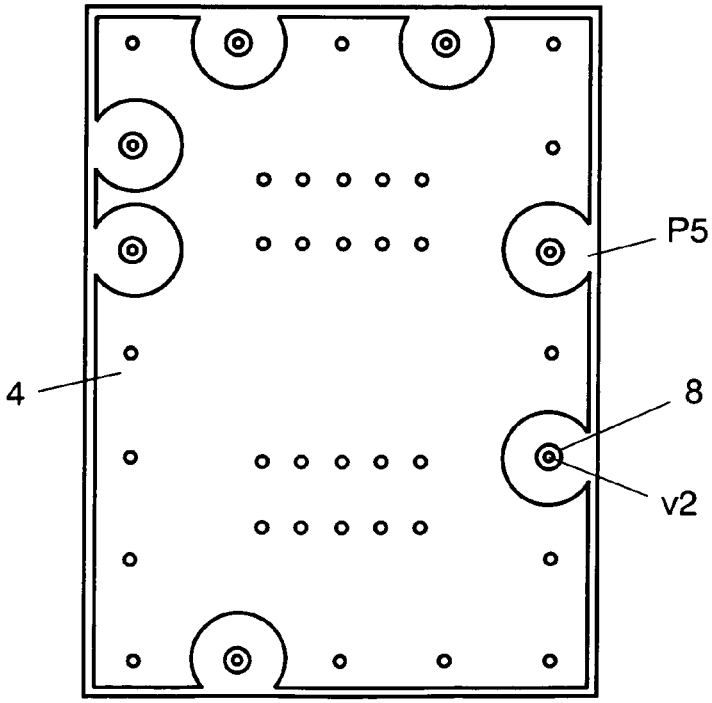
FIG. 6 shows a fifth layer of the antenna switch module of the embodiment.
Figure 7:
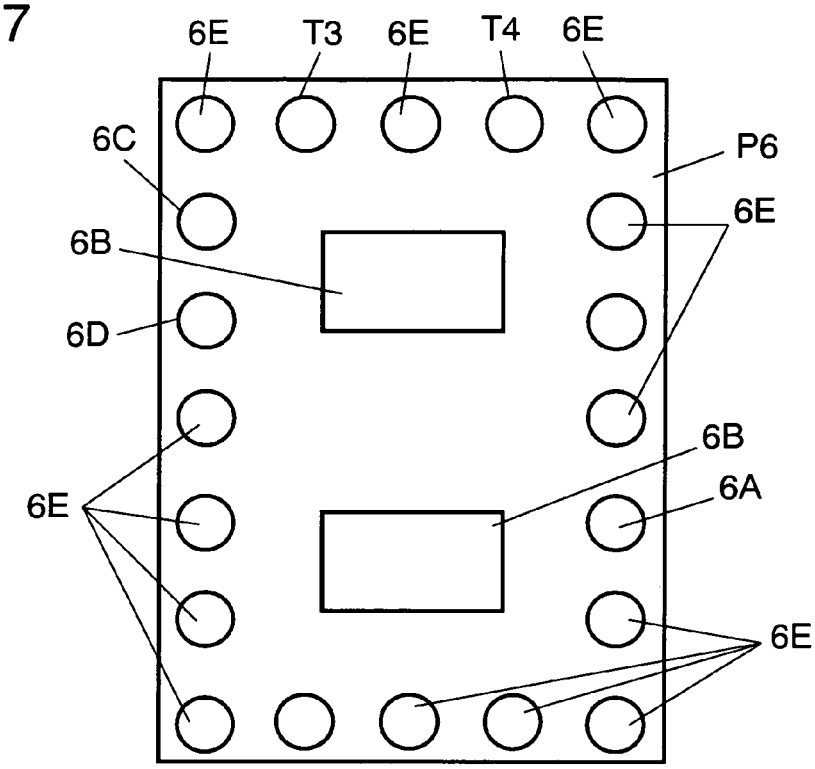
FIG. 7 shows a sixth layer of the antenna switch module of the embodiment.

FIG. 3 shows second layer P2 having ground parts 5A and 5B thereon. FIG. 4 shows third layer P3 having coupling line 15 thereon, which is a component of the directional coupler. FIG. 5 shows fourth layer P4 having filter 31 and adjustment line 13D thereon. FIG. 6 shows fifth layer P5 having ground part 4 thereon. FIG. 7 shows sixth layer P6 provided thereon with electrodes 6A to 6E. With layer P1 as the uppermost layer, layers P2 to P6 are arranged from above in this order. The antenna switch module of the present embodiment is connected with another device via P6.

The substrate of the antenna switch module of the present embodiment is made from low-temperature co-fired ceramics having a dielectric constant of 7.4, and is 5.4 mm by 4.0 mm and 0.7 mm in thickness. Ground parts 4, 5A and 5B; striplines 11A to 11D and 13A to 13C; adjustment line 13D; and coupling line 15 are formed by printing conductive paste mainly composed of silver powder.

In the present embodiment, striplines 11A to 11D, 13A to 13C and adjustment line 13D formed on the fourth layer have a characteristic impedance of 50 ohms, and a line width of 0.1 mm in the case of the low-temperature co-fired ceramics of the present embodiment. Filter 31 is made up of striplines 11A to 11D and 13A to 13C. Stripline 11A is connected with striplines 13A and 13B at junction point E1. Stripline 11B and 11C are connected with striplines 13B and 13C at junction point E2.

Stripline 11D is connected with stripline 13C and adjustment line 13D at junction point E3. In order to reduce the size of filter 31, striplines 11B, 11C, 13B and 13C are connected in the shape of a cross at junction point E2. Striplines 11A to 11D are open at one side, and have line lengths of ¼ wavelengths of 17.55 GHz, 14.7 GHz, 11.7 GHz and 9.8 GHz, respectively. Consequently, striplines 11A, 11B, 11C and 11D have a voltage swing of 0 at junction points E1 to E3 at 17.55 GHz, 14.7 GHz, 11.7 GHz and 9.8 GHz, respectively. In other words, striplines 11A to 11D are open stubs.

These striplines are bent to reduce the filter size, while keeping an interval long enough not to cause line coupling. In this embodiment, the line interval is made to be not less than 0.15 mm. Filter 31 may be made up of, instead of the ¼ wavelength open stubs, ½ wavelength short stubs whose each one side is grounded. In this case, it is necessary to insert a DC cut capacitor between filter 31 and antenna switch circuit 33.

The line lengths of striplines 13B and 13C are determined in such a manner that in the condition where striplines 11A to 11D are connected with each other, the impedance when junction point E1 is seen from the stripline 13A side and the impedance when junction point E3 is seen from adjustment line 13D can be 50 ohms at the fundamental frequencies. For example, in the case of the low-temperature co-fired ceramics of the present embodiment, striplines 13B and 13C have line lengths of 2.3 mm and 2.45 mm, respectively.

Stripline 13A is connected to round conductor 3. The fourth and fifth layers are connected with each other through via hole V1. The fifth layer is connected with electrode 6A on the sixth layer through via hole V2. Round conductor 8 connects between via holes V1 and V2. Electrode 6A on the sixth layer is connected with transmission part 41 through C11.

On ground part 4, part of the conductor pattern is cut in the form of a circle with a diameter not to cause electromagnetic coupling due to via hole V2. In the present embodiment, round conductor 8 has a diameter of 1.25 mm, and a via hole diameter of 0.5 mm. Round conductor 3 has a diameter of 0.75 mm in consideration of positional deviation or positional variation between round conductor 3 and the via hole due to manufacturing errors.

On the sixth layer, electrodes 6A to 6E are formed by printing conductive paste mainly composed of silver powder. Electrode 6A receives signals from transmission part 41 through capacitor C11. Electrodes 6C and 6D supply power to operate antenna switch circuit 33. A plurality of electrodes 6E assure a ground potential. The round electrode on the sixth layer has a diameter of 1 mm. In order to fix the potential of ground part 4 on the fifth layer, electrodes 6B, which are rectangles of 0.8 mm by 1.4 mm, are formed at the positions of ±0.7 mm from the center of the sixth layer in such a manner as to be symmetric with respect to the center. Electrodes 6B each include via holes, which are arranged in two columns and five rows at an interval of 0.3 mm by 0.5 mm, and are connected with ground part 4.

Adjustment line 13D is connected with round conductor 7, and is further connected with terminal T1 of antenna switch circuit 33 shown in FIG. 2 through via hole V3 connecting between the fourth and second layers, and via hole V4 connecting between the second layer and antenna switch circuit 33.

Figure 8:
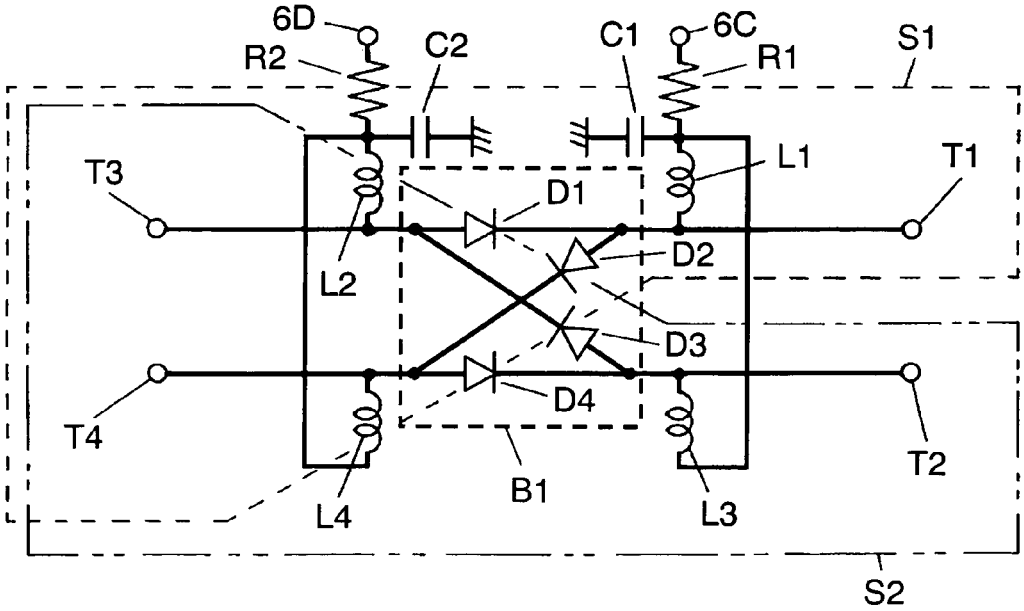
FIG. 8 shows the structure of an antenna switch circuit of the antenna switch module of the embodiment.

FIG. 8 shows the structure of antenna switch circuit 33 of the antenna switch module of the present embodiment. In FIG. 8, antenna switch circuit 33 includes terminals T1 to T4. Terminal T1 receives signals from transmission part 41. Terminal T2 outputs signals from antenna 44 or 45 to reception part 42. Terminal T3 is connected with antenna 44 through capacitor C13. Terminal T4 is connected with antenna 45 through capacitor C14. Antenna switch circuit 33 is provided with switch units S1 and S2. Switch unit S1 electrically connects/disconnects terminal T1 and terminals T3, T4. Switch unit S2 electrically connects/disconnects terminal T2 and terminals T3, T4.

Switch unit S1 includes PIN diode D1 connecting between terminal T1 and the cathode and between terminal T3 and the anode, and PIN diode D2 connecting between terminal T1 and the anode and between terminal T4 and the cathode. Switch unit S2 includes PIN diode D3 connecting between terminal T2 and the anode and between terminal T3 and the cathode, and PIN diode D4 connecting between terminal T2 and the cathode and between terminal T4 and the anode. PIN diodes D1 to D4 make up switching element B1.

Inductor L1 and capacitor C1 are connected in series with each other between ground 5B and the junction point of terminal T1 and PIN diode D1. Inductor L2 and capacitor C2 are connected in series with each other between ground 5B and the junction point of PIN diode D1 and terminal T3. Inductor L3 and capacitor C1 are connected in series with each other between ground 5B and the junction point of terminal T2 and PIN diode D4.

Inductor L4 and capacitor C2 are connected in series with each other between ground 5B and the junction point of PIN diode D4 and terminal T4. The junction point of inductors L1, L3 and capacitor C1 is connected with electrode 6C through resistor R1. The junction point of inductors L2, L4 and capacitor C2 is connected with electrode 6D through resistor R2.

Resistors R1 and R2 control the direct currents flowing to PIN diodes D1 to D4. Capacitors C1 and C2 bypass high frequency components to ground 5B. Inductors L1 to L4 block the high frequency components and supply direct current voltages to PIN diodes D1 to D4. Supplying a positive direct-current voltage to electrode 6C makes PIN diodes D2 and D3 "ON". Supplying a positive direct-current voltage to electrode 6D makes PIN diodes D1 and D4 "ON".

Figure 9:
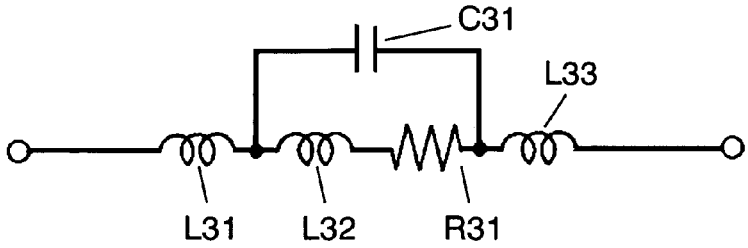
FIG. 9 is an equivalent circuit diagram when a PIN diode as a component of the antenna switch circuit of the embodiment is "ON".
Figure 10:
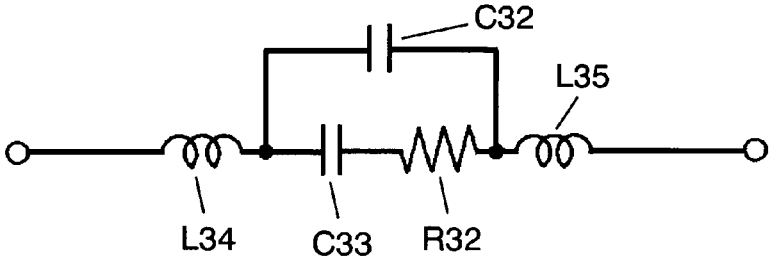
FIG. 10 is an equivalent circuit diagram when the PIN diode of the embodiment is "OFF".

FIG. 9 is an equivalent circuit diagram when a PIN diode as a component of the antenna switch circuit of the present embodiment is "ON", and the PIN diode is made up of inductors L31 to 33, capacitor C31 and resistor 31. FIG. 10 is an equivalent circuit diagram when the PIN diode of the present embodiment is "OFF", and the PIN diode is made up of inductors L34 and L35, capacitors C32 and C33, and resistor 32. In FIG. 4, coupling line 15, together with capacitor C5 and resistor R5, makes up directional coupler 35 by being in parallel with adjustment line 13D via the ceramics layer.

The operation of the antenna switch module of the present embodiment thus structured will be described as follows.

Figure 11:
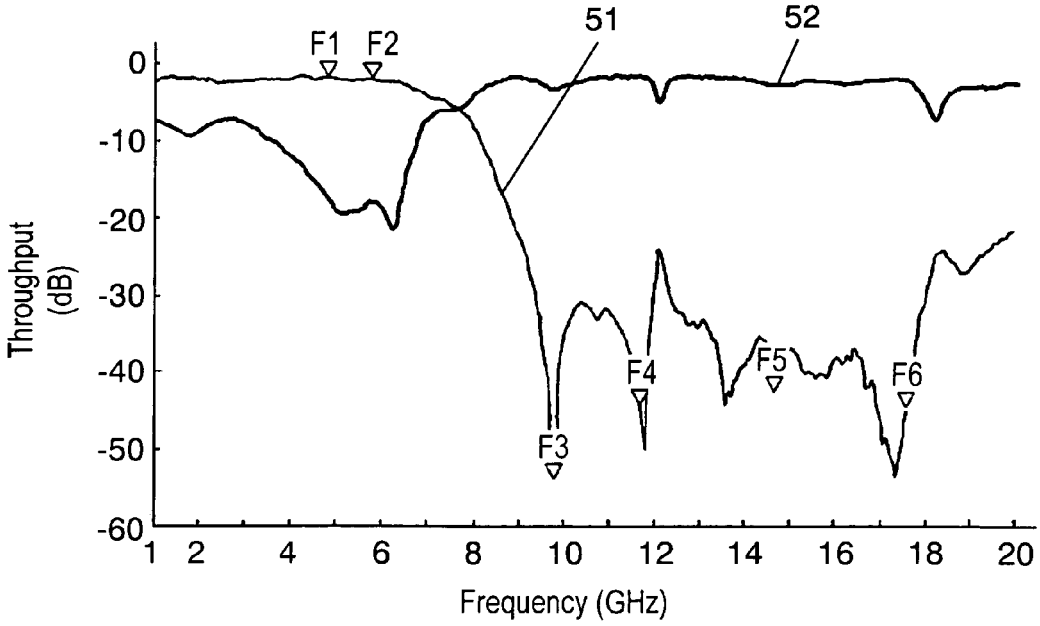
FIG. 11 shows frequency characteristics of the antenna switch module of the embodiment.
Figure 12:
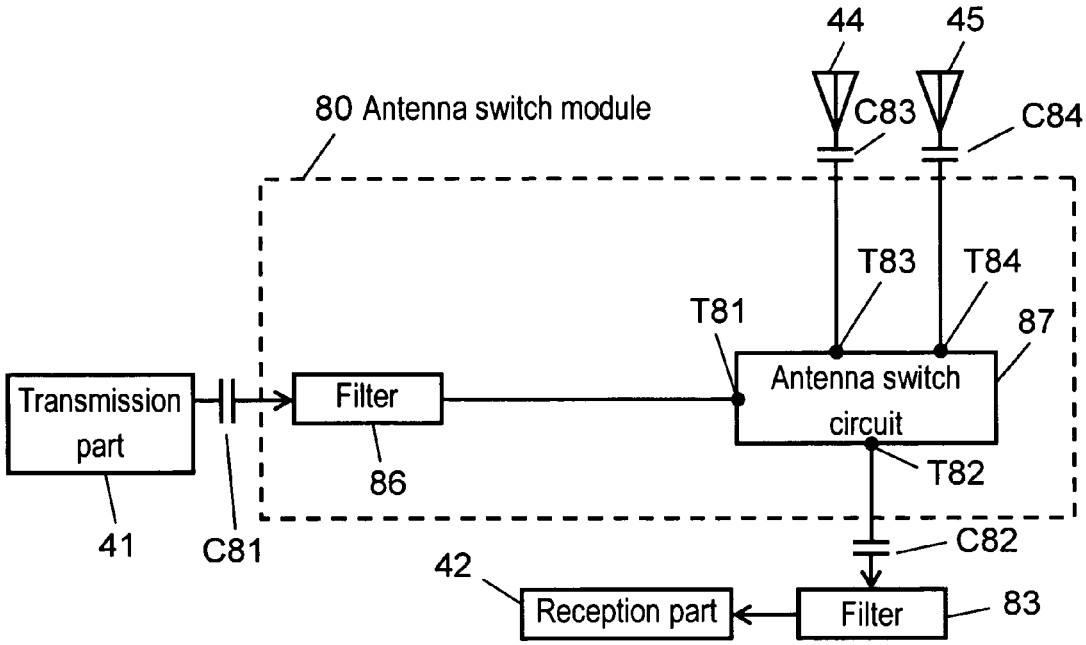
FIG. 12 PRIOR ART
FIG. 12 is a block diagram showing the structure of a communication device including a conventional antenna switch module.
Figure 13:
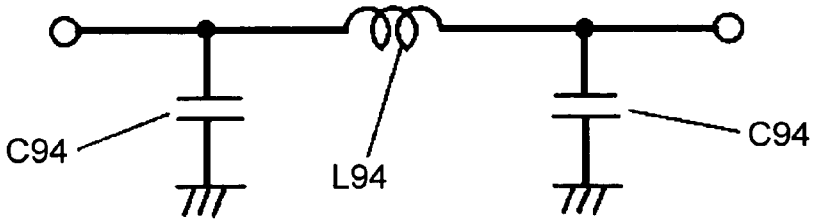
FIG. 13 PRIOR ART
FIG. 13 is a circuit diagram of a filter for the conventional antenna switch module.
Figure 14:
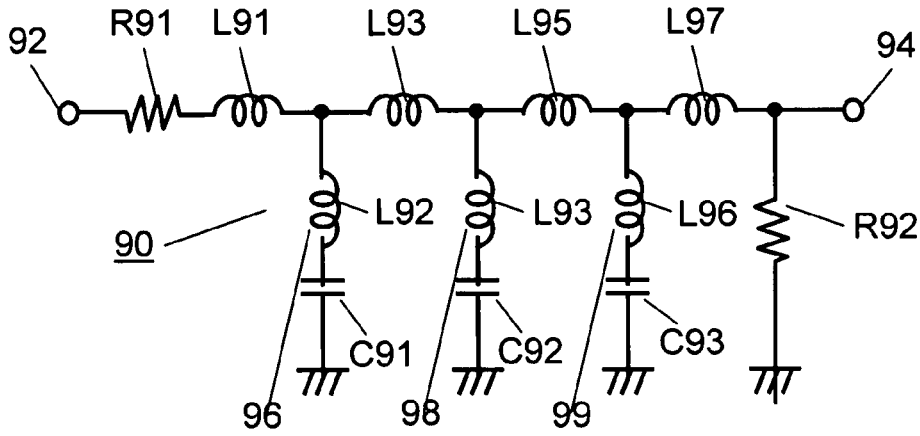
FIG. 14 PRIOR ART
FIG. 14 is a circuit diagram of another filter for the conventional antenna switch module.
Figure 15:
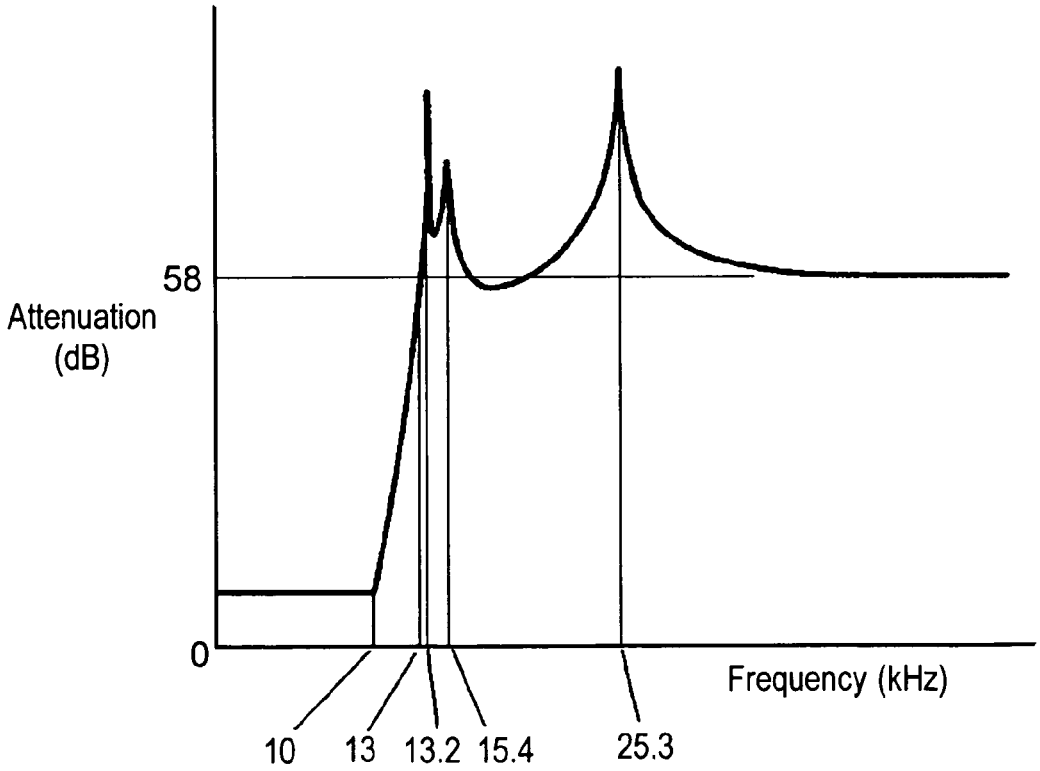
FIG. 15 PRIOR ART
FIG. 15 shows frequency characteristics of the filter for the conventional antenna switch module.
Figure 16:
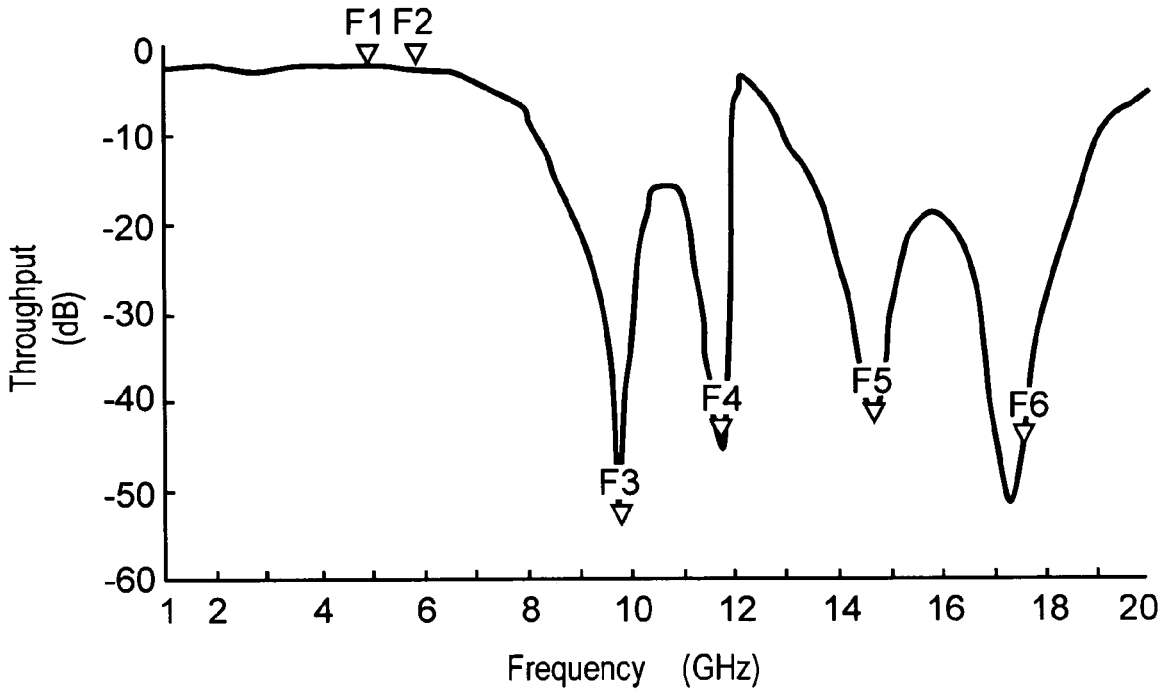
FIG. 16 PRIOR ART
FIG. 16 shows frequency characteristics of the conventional antenna switch module.

FIG. 11 shows frequency characteristics of the antenna switch module of the present embodiment. Passing signal 51 is passed from stripline 13A to terminal T3 or T4. Reflected signal 52 is a reflected signal corresponding to passing signal 51. In antenna switch circuit 33, the impedance when terminal T3 connected with capacitor C13 is seen from terminal T1 connected with adjustment line 13D is referred to with Z13. The impedance when terminal T2 connected with capacitor C12 is seen from terminal T4 connected with capacitor C14 is referred to with Z42. The impedance when terminal T4 is seen from terminal T1 is referred to with Z14. The impedance when terminal T2 is seen from terminal T3 is referred to with Z32.

As shown in FIG. 11, filter 31 formed on the fourth layer produces large attenuation poles with striplines 11A to 11D at the frequencies which are the second and third harmonics of the fundamental frequencies ranging from 4.9 GHz to 5.85 GHz. Furthermore, the length of adjustment line 13D made up of the striplines is controlled so as to prevent the impedance Z13 when stripline 13A is seen from round conductor 7 at the second and third harmonic frequencies and the impedance Z14 when antenna switch circuit 33 is seen from round conductor 7 from becoming complex conjugates of each other. In other words, impedances Z13 and Z14 are prevented from having an equal resistance component, and reactance components equal in size and opposite in sign.

The following is a more detailed description. Antenna switch circuit 33, which operates properly as a switch at the fundamental frequencies ranging from 4.9 GHz to 5.85 GHz, does not operate properly as a switch at frequencies of the second and higher harmonics of the fundamental frequencies. This is due to the influence of the reactance component shown in FIGS. 9 and 10. This situation is dealt with as follows. Measured data of antenna switch circuit 33 are inputted to an EM (electromagnetic) simulator. Next, the specifications of filter 31 made from low-temperature co-fired ceramics, that is, the actual layer structure and detailed requirements of the conductors such as conductor loss are inputted to the EM simulator. In the same manner, the specifications of adjustment line 13D, that is, the actual layer structure and detailed requirements of the conductors such as conductor loss are inputted to the EM simulator. The length of adjustment line 13D is changed to avoid a complex conjugate relation at the second and third harmonics, thereby obtaining favorable amount of attenuation and band width.

By using a notch low pass filter as the filter and controlling the length of adjustment line 13D, an antenna switch module can be provided which reduces filtering loss so as to ensure high attenuation in a wide band at harmonic frequencies.

The directional coupler can be alternatively made up of adjustment line 13D, coupling line 15, capacitor C5 and resistor R5. This allows more reflected waves to be detected from antenna 44 or 45, thereby controlling the transmission condition of transmission part 41.

As described hereinbefore, the antenna switch module of the present invention can easily reduce rebound components between two or more attenuation poles of the filter without degrading the amount of attenuation at the attenuation poles, thereby fully attenuating the harmonic components without increasing the number of stages of the filter.

In the present embodiment, it is alternatively possible to divide the ground part into ground part 5A and ground part 5B. Ground part 5A is for antenna switch circuit 33. Ground part 5B is for striplines 13B to 13C and 11A to 11D composing the filter on the fourth layer, and stripline 13A and round conductor 3 which are connected to transmission part 41.

This division of the ground allows the image current to flow through ground part 5A, and then into ground part 4 through via hole V5 connecting between ground part 5A and ground part 4.

Then, the image current flowing through ground part 4 is flown into ground part 5B through via hole V6 connecting between ground part 4 and ground part 5B. The path of the image current has a considerable line length at the second and higher harmonic frequencies of the fundamental frequencies ranging from 4.9 GHz to 5.85 GHz. In other words, the image current path functions as a choke coil for the current at the second and higher harmonic frequencies. As a result, in these frequencies, the antenna switch module of the present embodiment can obtain favorable amount of attenuation of 30 dB or higher.

The present embodiment takes up the case where the switching element of the antenna switch circuit is a PIN diode with excellent switch properties at high frequencies; however, the present invention is not limited to this case. Equivalent effects could be obtained by using as the switching element other electronic devices such as Ga (gallium) As (arsenic) switches having favorable switch properties at high frequencies, transistors, and electric field-effect transistors (FETs).

The filter or the adjustment line, which is formed of striplines in the present embodiment, could be formed of microstriplines to obtain the equivalent effects. Although four attenuation poles are used in the present embodiment, the number can be other than four. The filter, which is a notch low pass filter in the present embodiment, could be a polarized low pass filter to obtain the equivalent effects.

The filter, which is a low pass filter in the present embodiment, could be a band pass filter or a band rejection filter to obtain the equivalent effects. Although the multilayer substrate consists of six layers in the present embodiment, the number can be other than six.

INDUSTRIAL APPLICABILITY

As described hereinbefore, the antenna switch module of the present invention includes a filer which reduces transmission loss so as to achieve high attenuation in a wide band at harmonic frequencies and an adjustment line. Therefore, this is useful as an antenna switch module or the like including an antenna switch to switch antennas and a filter to remove spurious signals from the communication device.

What is claimed is:

1. An antenna switch module comprising:

a filter passing fundamental frequencies and having an attenuation pole, the filter having a first impedance;

an antenna switch circuit switching antennas which match the fundamental frequencies, the antenna switch circuit having a second impedance; and an adjustment line conductor of a set length connected between the filter and the antenna switch circuit, the set length of the adjustment line conductor adjusting properties at harmonic frequencies of the fundamental frequencies, wherein when the filter and the antenna switch circuit are connected with each other at a connection point on the adjustment line conductor, the set length of the adjustment line conductor prevents the first impedance and the second impedance from becoming complex conjugates of each other at the harmonic frequencies, wherein the first impedance and second impedance are measured from the connection point, wherein a ground layer is divided into a ground layer for the filter and a ground layer for the antenna switch circuit, wherein the antenna switch module includes a laminated body formed of a plurality of dielectric layers, wherein the filter is a notch low pass filter.

2. The antenna switch module of claim 1, wherein the antenna switch circuit includes an antenna switch element which is a PIN diode.

3. The antenna switch module of claim 2 further comprising:

a coupling line coupled with the adjustment line, wherein the coupling line and the adjustment line form part of a directional coupler.

4. The antenna switch module of claim 1, wherein the antenna switch circuit includes an antenna switch element which is a GaAs switch.

5. The antenna switch module of claim 1 further comprising a coupling line coupled with the adjustment line, wherein the coupling line and the adjustment line form part of a directional coupler.

6. An antenna switch module comprising:

a filter passing fundamental frequencies and having an attenuation pole, the filter having a first impedance;

an antenna switch circuit switching antennas which match the fundamental frequencies, the antenna switch circuit having a second impedance; and an adjustment line conductor of a set length connected between the filter and the antenna switch circuit, the set length of the adjustment line conductor adjusting properties at harmonic frequencies of the fundamental frequencies, wherein when the filter and the antenna switch circuit are connected with each other at a connection point on the adjustment line conductor, the set length of the adjustment line conductor prevents the first impedance and the second impedance from becoming complex conjugates of each other at the harmonic frequencies, wherein the first impedance and the second impedance are measured from the connection point, wherein the filter is a notch low pass filter.

7. The antenna switch module of claim 6, wherein the antenna switch circuit includes an antenna switch element which is a PIN diode.

8. The antenna switch module of claim 6, wherein a ground layer is divided into a ground layer for the filter and a ground layer for the antenna switch circuit.

9. The antenna switch module of claim 8, wherein the antenna switch module includes a laminated body formed of a plurality of dielectric layers.

10. The antenna switch module of claim 6, wherein the antenna switch circuit includes an antenna switch element which is a GaAs switch.

11. The antenna switch module of claim 6 further comprising:

a coupling line coupled with the adjustment line, wherein the coupling line and the adjustment line form part of a directional coupler.

* * * * *